United States Patent [19]

Cerrone, Jr.

[11] Patent Number: 4,869,389

[45] Date of Patent: Sep. 26, 1989

[54] COVER FOR CONTAINER WITH SCREEN TO PREVENT INSECT INTRUSION

[76] Inventor: Frank J. Cerrone, Jr., R.D. 1, 614 Malen Ave., Westville, N.J. 08093

[21] Appl. No.: 182,420

[22] Filed: Apr. 18, 1988

[51] Int. Cl.[4] ..... B65D 17/00

[52] U.S. Cl. ..... 220/90.2; 220/90.4; 220/356

[58] Field of Search ..... 220/90.2, 90.4, 90.6, 220/356; 229/906.1, 15 B

[56] References Cited

U.S. PATENT DOCUMENTS

| | | | |
|---|---|---|---|
| 2,106,453 | 1/1938 | Ekdahl | 210/155 |
| 3,938,695 | 2/1976 | Ruff | 220/90.4 |
| 3,940,012 | 2/1976 | Addington | 220/90.4 |
| 3,957,097 | 5/1976 | Swett | 220/356 X |
| 4,331,255 | 5/1982 | Fournier | 220/90.4 X |
| 4,537,326 | 8/1985 | Morehead | 220/90.2 X |
| 4,619,372 | 10/1986 | McFarland | 220/90.4 |

FOREIGN PATENT DOCUMENTS

| | | |
|---|---|---|
| 25262 | 3/1906 | Austria . |
| 187588 | 7/1907 | Fed. Rep. of Germany . |
| 345851 | 1/1937 | Italy . |
| 22552 | of 1908 | United Kingdom . |

OTHER PUBLICATIONS

Copy of Coffee Cup Cap (undated).

*Primary Examiner*—Steven M. Pollard
*Attorney, Agent, or Firm*—Thomas A. Lennox

[57] ABSTRACT

A plastic snap fit cover for a carbonated beverage can includes an aperture through the cover aligned with the snap tab opening in the top of the can with an integrally molded screen across the aperture of a size to allow free drinking through the cover and yet prevent the intrusion of insects, such as bees, into the can.

16 Claims, 3 Drawing Sheets

COVER FOR CONTAINER WITH SCREEN TO PREVENT INSECT INTRUSION

BACKGROUND OF THE INVENTION

This invention involves a cover for a container which will allow flowable material to exit while preventing intrusion of insects. In particular, this inventions involves a cover for a sugared drink can allowing it to be consumed but preventing insects, in particular bees, from entering.

Outdoor gatherings at which food and beverages are served are a universally enjoyed pastime, but insects can be a distracting problem. In addition to the venerable ants at picnics, a more troublesome modern problem is bees and other insects which are strongly attracted to open cans or bottles of soda or beer. For purposes of this application, it is assumed that the primary attractant in these beverages is sugar, but it may be the fruit or malt flavoring that add to the attraction. In any case, it is now uncommon to be able to set down a can of carbonated beverage and not have bees congregate on the top and typically enter into the opening. If a person is not careful, it is easy to pick up the drink and attempt to consume it with the insect inside, leading to disastrous results. Other insects such as gnats, flies and other insects are also attracted to the soda and commonly enter into the opening. In some cases, the insect is overcome but it is equally distressing to find a dead insect in the last drink from the can or bottle.

Prior art devices including a variety of drinking container covers do not satisfy the above needs nor attain the objects listed hereinbelow.

SUMMARY OF THE INVENTION

It is an object of the present invention to provide a cover for a container which will allow flowable material to freely flow out through the container and through an opening in the cover but yet prevent the intrusion of insects through the cover and into the container.

It is a particular object of this invention to provide a cover for a carbonated beverage can having a snap top opening, the cover having an opening through which the beverage can be poured or directly consumed by placing it to the mouth and yet prevent intrusion of insects into the can container.

It is an additional object of the present invention to provide a cover for a container that will interfit over the top of a carbonated beverage can and seal it from leakage except through a designated opening shaped to be easily used to directly consume the beverage.

It is a further object of the present invention to provide a cover for a beverage container with an aperture through the cover with a screen closing that aperture constructed such that stray liquid remaining on the screen will collect and flow back into the container.

It is a further object of the present invention to provide a cover for a beverage container which can be easily attached and detached from the can to be reused.

It is a particular object of the present invention to provide a cover wherein the screened aperture prevents the intrusion of bees into the container.

It is a particular object of the present invention to provide a cover which prevents the intrusion of bees wherein no modification or attachment directly to the top of the can is required except around the peripheral edge of the can.

The invention is a cover for a container having a top, a top outer edge, and an opening through the top from which flowable material, such as a carbonated beverage containing sugar, flows when the container is tilted toward the opening, wherein the flowable material comprises an attractant to insects. The cover includes a cover panel having an outer peripheral edge essentially coterminous with the top outer edge of the container and an attaching means to detachably engage the outer peripheral edge of the cover panel over the outer edge of the container to hold the cover on the container. The cover further includes an aperture through the cover panel positioned to be alignable with at least a major portion of the can opening, and a screen integral with the cover panel closing the aperture. The screen includes a multiplicity of passages through the screen of a size and shape sufficient to allow free flow of the material out of the container through the cover aperture and to prevent the ingress of insects through the aperture into the container. A preferred container is a cylindrical can with a snap opening using a tab attached to the top of the can, wherein the attractant is sugar in a liquid, such as a carbonated soda or beer, and the aperture screen is depressed below the height of the cover panel. A preferred cover is the attaching means including a downwardly depending rim of a shape to snap fit over the outer edge of the top of the container. It is preferred that the aperture screen be depressed below the height of the peripheral edge of the cover. A preferred cover includes an integral lip extending horizontally from the outer peripheral edge of the cover panel proximate the aperture. The preferred cover is an integral molding of a thermoplastic polymer, wherein the screen comprises a multiplicity of polymeric plastic cross members integrally molded with the cover. It is preferred that a bottom surface of the cover panel facing the container top be at a height above the container top outer edge when the attaching means is engaged on the top outer edge. In this embodiment it is preferred that the cover panel be formed to a lower height proximate the aperture forming a depression leaving an upraised rim around the peripheral edge proximate the aperture.

A preferred embodiment of the invention is a cover for a cylindrical can container having a circular top, a circumferential top outer edge, and an opening through the top from which liquid flows when the can is tilted toward the opening, wherein the liquid comprises an attractant to insects. This cover includes a circular cover panel having a peripheral edge essentially coterminous with the top outer edge of the container and an attaching means to detachably engage the outer peripheral edge of the cover panel over the outer edge of the container including a downwardly depending rim of a shape to snap fit over the outer edge of the container. This cover also includes an aperture through the cover panel positionable proximate to the opening in the top of the can and a screen integral with the cover panel closing the aperture. The screen includes a multiplicity of passages through the screen of a size and shape sufficient to allow free flow of the liquid out of the container through the cover aperture and to prevent the ingress of insects through the aperture into the container. This cover includes an integral lip extending horizontally from the outer peripheral edge of the cover panel.

DESCRIPTION OF PREFERRED EMBODIMENTS

Figure 1:
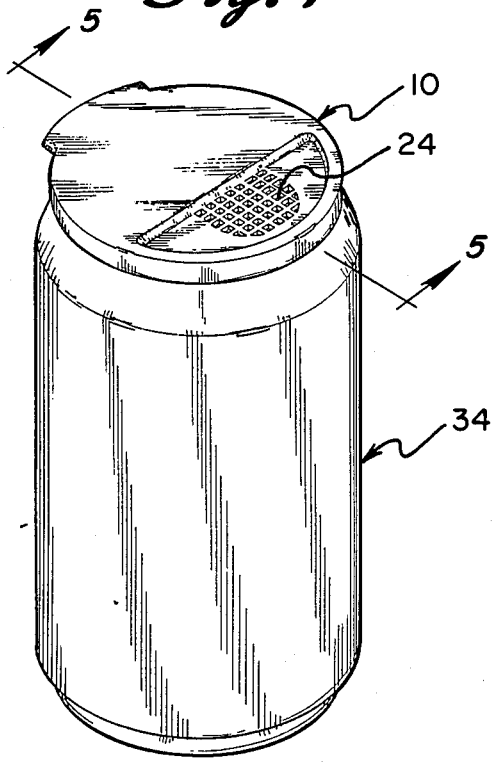
FIG. 1 is a perspective view of a can onto which a cover of the present invention is attached.
Figure 2:
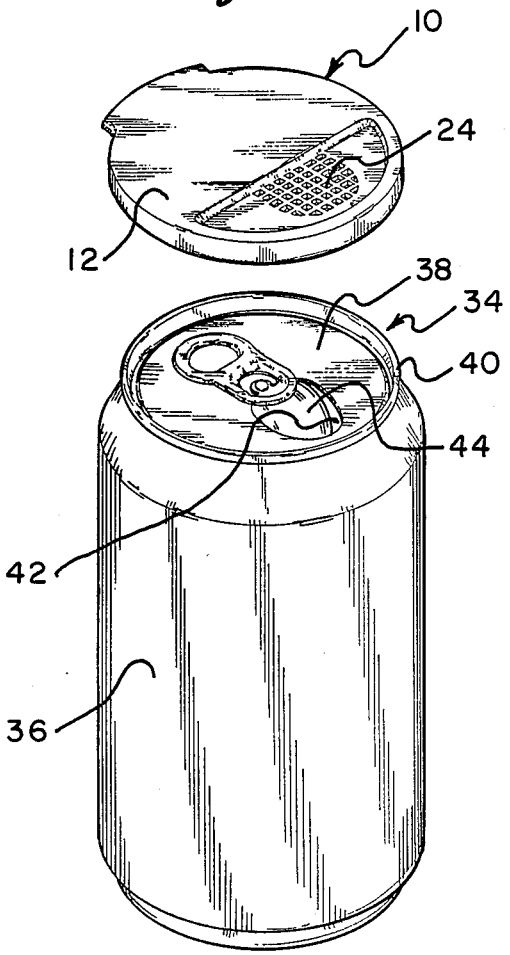
FIG. 2 is an exploded perspective view showing the cover removed from the container.
Figure 3:
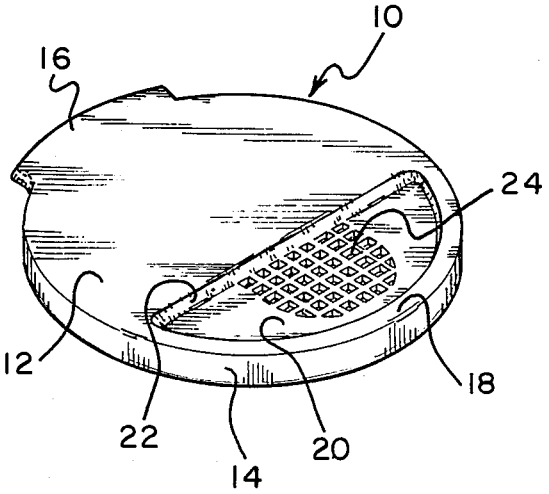
FIG. 3 is an exploded perspective view of the cover illustrated in FIGS. 1 and 2 viewing from the top.
Figure 5:
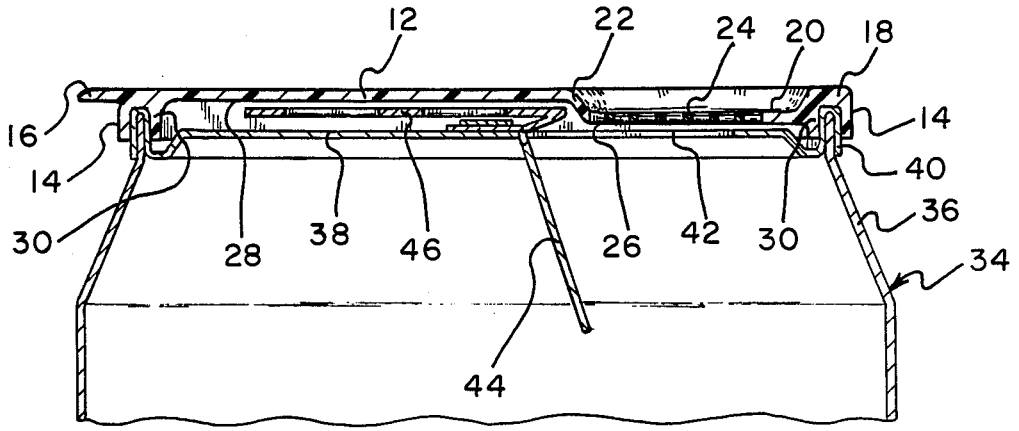
FIG. 5 is a cross-sectional view taken along lines 5—5 of FIG. 1.
Figure 4:
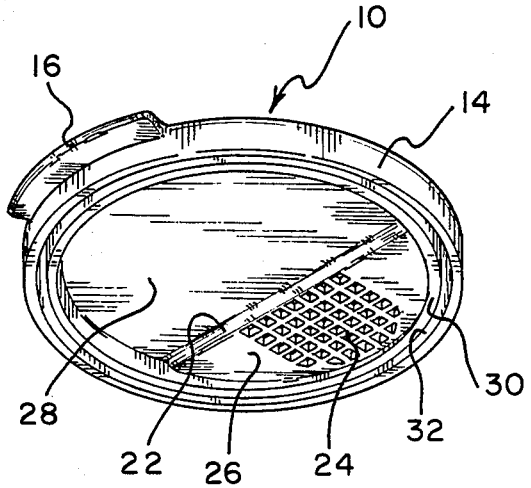
FIG. 4 is a perspective view of the cover illustrated in FIG. 3 viewing from the bottom.

FIG. 1 is perspective view of can 34 onto which cover 10 has been snap fitted on the top. As is further illustrated in FIG. 2, with the cap removed in alignment above can 34 aperture 24 was positioned in FIG. 1 directly over opening 42 through top 38 to the interior of can 34. Can 34 includes cylindrical side wall 36 and upper outer edge 40 of top 38. Cover 10 includes cover panel 12 extending over the entire top 38 of can 34. Cover 10 is injection molded of a polyolefin plastic such as polyethylene, polypropylene or the like. These hydrophobic plastics are preferred to promote free flow of stray liquid back into the container. In FIG. 3, the details of cover 10 are better illustrated including depending outer rim 14 which extends down over can upper edge 40 to snap fit onto the can. Tab 16 extends outwardly from cover panel 12 to allow easy removal of cover 10 when the container is emptied. Depressed surface 20 is at the bottom of a recess lowered from cover panel 12 formed by step 22 and the inside edge step of outer edge 18 of cover panel 12. Positioned on depressed section 20 is screen opening 24 which is an integrally molded plastic screen molded as a part of cover 10 having a multiplicity of openings proximate to that of window screen. These openings are of sufficient size and shape to allow free flow of liquid out through opening 24 and yet prevent the intrusion of insects through these openings. In FIG. 4, the view from the bottom of cover 10 bottom inside surface 28 of cover panel 12 is shown in this view as being higher than surface 26 which is the bottom of depressed section 20. Step 22 is shown in this view from the bottom to provide the lower position of section 20. Inner rim 30 depending downwardly from cover 12 forms annular ring slot 32 between it and edge rim 14. As cover 10 is forced onto raised edge 40 of can 34, it is forced into annular slot 32 such that depending edges 30 and 14 grip the can. As further illustrated in FIG. 5, can 34 includes cylindrical side walls 36 and top 38 which join at crimped upper edge 40 around which snap fits outer cover edge 14 and inner depending extension 30. Opening 42 through can top 38 is positioned below screen aperture 24. As cover panel 12 is stepped up from step 22, the height of lower surface 28 is well above can tab 46 which is used to open and depress can opening cut out 44.

Figure 6:
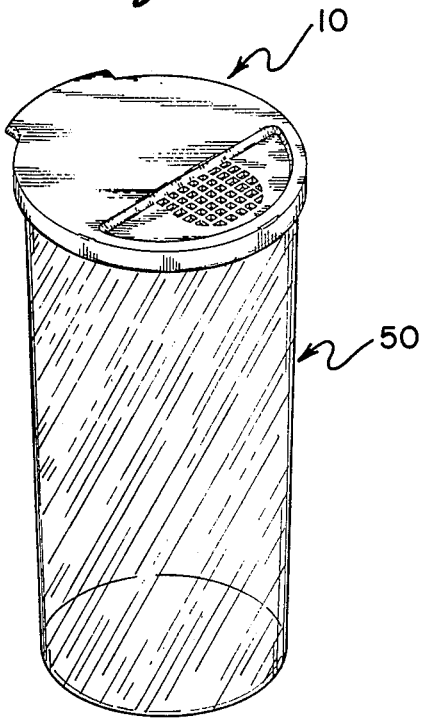
FIG. 6 is a perspective view of a glass with a cover of the present invention attached.
Figure 7:
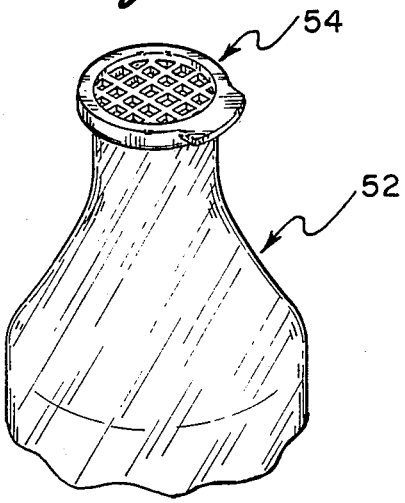
FIG. 7 is a perspective view of a bottle with a cover of the present invention attached over the opening.

In FIG. 6, cover 10 snap fits over plastic glass 50 to provide the same function as when it is used on top of a can. In FIG. 7, cover 54 is sized to fit over bottle top 52 includes the same elements to snap fit cover 54 over the edge of the opening in bottle 52, but because of its size does not require the depressed area and raised rim to facilitate drinking and collection of tray fluids that the depressed panel 20 provides.

Figure 8:
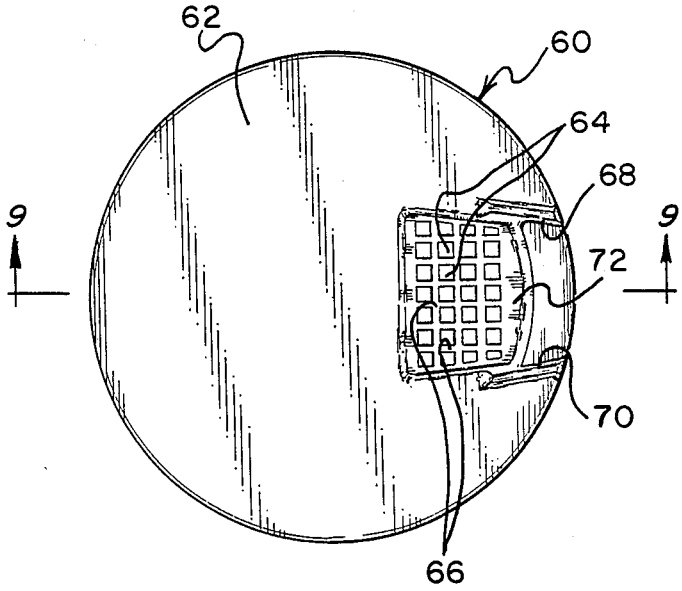
FIG. 8 is a top view of another embodiment of the cover of the present invention.
Figure 9:
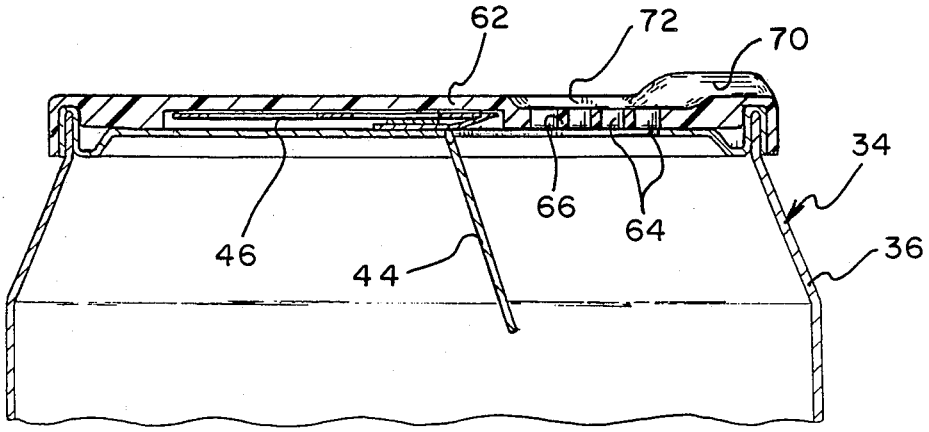
FIG. 9 is a diagram depicting a vertical crosssectional view taken from the side viewing the cover illustrated in FIG. 8 on the top of a can.

FIG. 8 is an additional embodiment cover 60 which includes cover panel 62 which is entirely flat. In this embodiment, cover panel 62 is essentially flat accept that there is a slight depression in the area of openings 64 which form the aperture screened off by plastic cross members 66 to prevent the intrusion of large insects, such a bees. In FIG. 9, depression 70 is sufficient to allow stray liquid to drain back into the can, and side rails 68 and 70 facilitate drinking directly through the cover.

While this invention has been described with reference to the specific embodiments disclosed herein, it is not confined to the details set forth and the patent is intended to include modifications and changes which may come within and extend from the following claims.

I claim:

1. A cover for a container having a top, a top outer edge, and an opening through the top from which flowable material flows when the container is tilted toward the opening, wherein the flowable material comprises an attractant to insects, the cover comprising:

(a) a cover panel having an outer peripheral edge essentially coterminous with the top outer edge of the container, (b) attaching means to detachably engage the outer peripheral edge of the cover panel over the outer edge of the container, wherein a bottom surface of the cover panel facing the container top is at a height above the container top outer edge when the attaching means is engaged on the top upper outer edge, (c) an aperture through the cover panel positioned to be allignable with at least a major portion of the can opening, and (d) a screen integral with the cover panel closing the aperture, the screen comprising a multiplicity of passages through the screen of a size and shape sufficient:

(i) to allow free flow of the material out of the container through the cover aperture, and (ii) to prevent the ingress of insects through the aperture into the container.

2. The cover of claim 1 wherein the container is cylindrical can with a snap opening using a tab attached to the top of the can.

3. The cover of claim 1 wherein the attractant is a sugar in a liquid in the container.

4. The cover of claim 1 wherein the aperture screen is depressed below the height of the cover panel of the cover.

5. The cover of claim 1 wherein the attaching means comprises a downwardly depending rim of a shape to snap fit over the outer edge of the top of the container.

6. The cover of claim 1 wherein the screen comprises a multiplicity of polymeric plastic cross members integrally molded with the cover.

7. The cover of claim 1 wherein the cover panel is formed to a lower height proximate the aperature forming a depression leaving an upraised rim around the peripheral edge proximate the aperature.

8. The cover of claim 1 further comprising an integral lip extending horizontally from the outer peripheral edge of the cover panel.

9. The cover of claim 1 wherein the cover is an integral molding of a thermoplastic polymer.

10. A cover for a cylindrical can container having a circular top, a circumferential top outer edge, and an opening through the top from which liquid flows when the can is tilted toward the opening, wherein the liquid comprises an attractant to insects, the cover comprising:

(a) a circular cover panel having a peripheral edge essentially coterminous with the top outer edge of the container, (b) attaching means to detachably engage the outer peripheral edge of the cover panel over the outer edge of the container comprising a downwardly depending rim of a shape to snap fit over the outer edge of the container, wherein a bottom surface of the cover panel facing the container top is at a height above the container top upper outer edge when the attaching means is engaged on the top upper outer edge, (c) an aperture through the cover panel proximate in size and shape to the opening in the top of the can, and (d) a screen integral with the cover panel closing the aperture, the screen comprising a multiplicity of passages through the screen of a size and shape sufficient:

(i) to allow free flow of the liquid out of the container through the cover aperture, (ii) to prevent the ingress of insects through the aperture into the container wherein the aperture screen is depressed below the height of the cover panel of the cover, and (e) an integral lip extending horizontally from the outer peripheral edge of the cover panel.

11. The cover of claim 10 wherein the attractant is a sugar in a liquid in the container.

12. The cover of claim 10 wherein the screen comprises a multiplicity of polymeric plastic cross members integrally molded with the cover.

13. The cover of claim 10 wherein the cover panel is formed to a lower height proximate the aperature forming a depression leaving an upraised rim around the peripheral edge proximate the aperature.

14. The cover of claim 10 further comprising an integral lip extending horizontally from the outer peripheral edge of the cover panel.

15. The cover of claim 10 wherein the cover is an integral molding of a thermoplastic polymer.

16. A cover for a container having a top, a top outer edge, and an opening through the top from which flowable material flows when the container is tilted toward the opening, wherein the flowable material comprises an attractant to insects, the cover being an integral plastic molding comprising:

(a) a cover panel having an outer peripheral edge essentially coterminous with the top outer edge of the container, (b) attaching means to detachably engage the outer peripheral edge of the cover panel over the outer edge of the container comprising a downwardly depending rim of a shape to snap fit over the outer edge of the top of the container, (c) an aperture through the cover panel positioned to be allignable with at least a major portion of the can opening, and (d) a screen integral with the cover panel closing the aperture, the screen comprising a multiplicity of passages through the screen of a size and sshape sufficient:

(i) to allow free flow of the material out of the container through the cover aperture, and (ii) to prevent the ingress of insects through the aperture into the container, wherein a bottom surface of the cover panel facing the container top is at a height above the container top upper outer edge when the attaching means is engaged on the top upper outer edge and the cover panel is formed to a lower height proximate the aperature forming a depression leaving an upraised rim around the peripheral edge proximate the aperture.

* * * * *